US011183023B2

(12) United States Patent
Hirsch

(10) Patent No.: US 11,183,023 B2
(45) Date of Patent: Nov. 23, 2021

(54) SYSTEM FOR A MASSIVE MULTI-PLAYER GAME OF SKILL

(71) Applicant: Platform Gaming Technologies, Inc., Tampa, FL (US)

(72) Inventor: David Brian Hirsch, Tampa, FL (US)

(73) Assignee: Platform Gaming Technologies, Inc., Indianapolis, IN (US)

( * ) Notice: Subject to any disclaimer, the term of this patent is extended or adjusted under 35 U.S.C. 154(b) by 181 days.

(21) Appl. No.: 16/394,189

(22) Filed: Apr. 25, 2019

(65) Prior Publication Data

US 2019/0333337 A1 Oct. 31, 2019

Related U.S. Application Data

(60) Provisional application No. 62/664,347, filed on Apr. 30, 2018.

(51) Int. Cl.
*G07F 17/32* (2006.01)

(52) U.S. Cl.
CPC ..... *G07F 17/3276* (2013.01); *G07F 17/3223* (2013.01); *G07F 17/3293* (2013.01)

(58) Field of Classification Search
None
See application file for complete search history.

(56) References Cited

U.S. PATENT DOCUMENTS

2002/0185816 A1 12/2002 Moody et al.
2005/0032563 A1* 2/2005 Sines ..... A63F 3/00157 463/13
2005/0040601 A1 2/2005 Yoseloff et al.
2009/0250875 A1 10/2009 Matanky
2014/0087804 A1 3/2014 Snow
2014/0357335 A1* 12/2014 Baker ..... G07F 17/3293 463/13
2018/0158285 A1* 6/2018 Mahasuverachai ..... G07F 17/3223

FOREIGN PATENT DOCUMENTS

WO 2008021264 2/2008

* cited by examiner

*Primary Examiner* — James S. McClellan
*Assistant Examiner* — Peter J Iannuzzi
(74) *Attorney, Agent, or Firm* — Larson & Larson, P.A.; Frank Liebenow; Justin P. Miller

(57) ABSTRACT

A gaming system includes a server and player. The server randomly selects and removes a set of community cards from a deck then requests a first wager from each player. For each player, the server randomly selects a non-exclusive set of hole cards. After the server collects the first wager, the server displays the set of community cards to all players that are playing and requests a second wager from each player. Until all hole cards are presented, each player that is playing is presented a next subset of the hole cards. Each player that does not make the subsequent wager is declared as not playing. After all hole cards are presented, a winner(s) is/are declared based upon a rank of hands.

20 Claims, 8 Drawing Sheets

SYSTEM FOR A MASSIVE MULTI-PLAYER GAME OF SKILL

CROSS-REFERENCE TO RELATED APPLICATION

This application claims the benefit of U.S. provisional application No. 62/664,347 filed on Apr. 30, 2018, the disclosure of which is incorporated by reference.

FIELD

This invention relates to the field of entertainment and more particularly to a system to administer massive multi-player games of skill for traditional gaming formats where the number of players who can typically play is limited.

BACKGROUND

Games of skill typically rely upon the knowledge and/or ability of the players in determining the outcome. However, almost all games of skill possess some level of randomness or chance.

A game of skill depends, at least somewhat, upon each player's skills, but being a game, there is still some level of randomness, otherwise, the most skillful player will always win. Typically, operators of games of skill establish rules and scoring criteria that are fair with completely objective standards that are outside the control of the players and the game operator.

Some games of skill, because of physical and practical limitations, only enable a relatively small number of players to play at any given time.

One example of a widely played game of skill of this type is poker. Millions of people play poker each week. Traditionally, poker is played in a table setting with a single deck of cards. A single deck of cards has 52 individual cards. In traditional formats of poker, each player will have a certain number of cards that are exclusive to them. As such, the number of people who can play in a single game of poker is limited. For example, in the poker game of Texas Hold'em, each player is dealt two cards face down, known as "hole cards", and then five community cards are dealt face down, then exposed in three sequential stages (three first, then another one, and then the last one). Hole cards are exclusive to each player, whereas the community cards are not exclusive and are available to all players to incorporate into their hands. Each player seeks the best five card poker hand from any combination of the seven cards of the five community cards and their own two hole cards. Therefore, after accounting for the five community cards, a single game or table of Texas Hold'em can only accommodate 23 players at most (each player receiving two hole cards, or 46 cards hole cards total plus the five Community Cards, which totals 51 cards of the 52 cards in the deck).

A further physical limitation relates to the number of seats at a given table. Although up to 23 people could conceivably play Texas Hold'em at a single table, physically accommodating 23 people is highly-impracticable due to space limitations. This is not only true of Texas Hold'em when played with real cards in an actual physical location, but also when played online either through a browser or mobile interface because screen real estate is limited. As such, most operators of Texas Hold'em limit the number of players in a single game to ten or less at any given time.

Another practical limitation is time. Poker games, including Texas Hold'em, utilize what is commonly referred to as "table wagering" where wagering is performed sequentially by each player in various rounds. Table wagering can be complicated and time consuming. For example, Texas Hold'em has three stages when additional community cards are dealt or revealed to the players. In the first stage, commonly referred to as "the flop", a series of three cards are revealed to the players. In the next stage, an additional single card, commonly referred to as "the turn" is dealt, and then in the third stage, a final card, commonly referred to as "the river" is dealt. Rounds of sequential betting take place before and after the flop and then after each subsequent stage. During each round of betting, players make wagering decisions sequentially and have the option to check, call, raise, or fold. Betting order typically flows clockwise around the table of play for at least one rotation. However, several full rotations might occur before a given round is concluded. Normally, players have a limited time to make their betting decisions (i.e. 30 seconds or less to submit a decision or a forced fold is imposed). A single round of wagering might last a single rotation and end in a matter of seconds, or multiple rotations might occur, which can take several minutes to conclude. When more players are playing in a given game, more sequential player decisions are required and the game will usually take much longer. At some point, the duration of a game becomes impracticable and certainly less enjoyable for the players. This is another reason why many operators limit the number of players in a single game to ten or less.

A final consideration relates to the way traditional poker games are scored and the number of players who win at the end of a given game. In Texas Hold'em, each player seeks the best five card poker hand from any combination of the seven cards of the five community cards and their own two hole cards. Traditionally, poker hands are measured based on a standard set of rules. For example, three-of-a-kind beats two of a kind, and a full house beats a flush, and so on. These rules provide an adequate level of granularity for games with a limited number of players; however, further granularity is needed for games where thousands or even hundreds of thousands of entrants are playing. In poker or Texas Hold'em, after the final round of table wagering has concluded, the remaining players reveal their hands and the player with the best hand wins the entire pot. Although this winner-takes-all formulation works well when the number of players of a given game is limited, it becomes less attractive as when larger numbers of people play. For example, if ten people play and there is one winner, the winning hand is in the top ten percent. However, if a thousand people play, and one person wins, that same winning hand represents $1/10^{th}$ of one percent. Although the prize pool would be considerably larger, the odds of winning fall significantly leaving 999 players with no payout at all. For many players, this result would be less attractive.

What is needed are new game formats of traditional games, such as poker, that (1) enable larger numbers of players to play in a single game, (2) employ simpler betting mechanics, (3) can be played in shorter durations, (4) employ a scoring system that provides greater granularity and differentiation amongst the players, and (5) utilize payout schemes that are more appropriate for games with larger numbers of players where a greater number or percentage of players have the potential to win at the game's conclusion.

SUMMARY

People are typically more likely to participate in games where their knowledge and skill gives them an edge, particularly when the winners of a given game have paid an entry fee to participate and/or could win money based on the outcome.

Additionally, people are more likely to participate in games of skill that enable more players to play, are easier to play, shorter in duration, offer a higher level of scoring differentiation and a greater chance of winning.

This is especially true for games that require an entry fee or wagering and offer a progressive prize pool because the potential for winning larger prizes increases with the number of players.

In one embodiment, a gaming system is disclosed including a server and a plurality of player client devices. Each player client device is associated with a player. There is a software representation of a deck of cards and the server randomly selects and removes a set of community cards from the deck of cards. The server requests a first wager from each player client device and each player client device that makes the first wager is declared as playing. For each player client device that is playing, the server randomly selects a non-exclusive set of hole cards from the deck of cards. After the server collects the first wager and adds the wager to a pot, the server displays the set of community cards on all player client devices that are playing and requests a second wager from each player client device that is playing. Until all hole cards are presented, for each player client device that is playing, the server presents a next subset of the hole cards, requests a subsequent wager from each player client device, for each player client device that makes the subsequent wager, the subsequent wager is added to the pot; and each player client device that does not make the subsequent wager is declared as not playing. After all hole cards are presented, one or more winners are declared based upon a rank of hands, the hands include the hole cards of each player and the community cards.

In another embodiment, a method of gaming by a set of players is disclosed including randomly selecting and removing a set of community cards from a deck of cards. Next, requesting a first wager from each player and each player making the first wager is added to the set of players that are in. For each player in the set of playing players that are in, randomly selecting a non-exclusive set of hole cards from the deck of cards then displaying the set of community cards to all players in the set of players that are in. Next, requesting a second wager from each player that is in the set of players that are in and until all hole cards are presented, for each player in the set of players that are in, presenting a next subset of the hole cards and requesting a subsequent wager from each player in the set of players that are in. Each player that does not make the subsequent wager is removed from the set of players that are in. After all hole cards are presented, the hand of each player in the set of players that are in is ranked, and one or more winners is/are declared based upon the rank. The hands include the hole cards of each player and the community cards.

In another embodiment, program instructions tangibly embodied in a non-transitory storage medium comprising at least one instruction configured to implement a system for gaming between a set of players is disclosed in which at least one instruction includes computer readable instructions executed by a processor causing the system for gaming to randomly select and remove a set of community cards from a deck of cards and to request a first wager from each player of the set of players. The computer readable instructions executed by the processor causing the system for gaming to add each player that makes the first wager to a set of in players. For each player in the set of in players, the computer readable instructions executed by the processor causing the system for gaming to randomly select a non-exclusive set of hole cards from the deck of cards and to assign that non-exclusive set of hole cards to the each player in the set of in players. Next, the computer readable instructions executed by the processor causing the system for gaming to display the set of community cards to all players in the set of in players and to request a second wager from each player that is in the set of in players. Until all hole cards are presented, for each player in the set of players that are in, the computer readable instructions executed by the processor causing the system for gaming to present a next subset of the hole cards and to request a subsequent wager from each player in the set of in players. The computer readable instructions executed by the processor causing the system for gaming to remove each player from the set of in players that does not make the subsequent wager and after all hole cards are presented, the computer readable instructions executed by the processor causing the system for gaming to rank a hand of each player in the set of in players, and to declare one or more winners based upon the rank, the hands comprising the hole cards of each player and the community cards.

In some embodiments, a game format for poker is disclosed where the number of players is theoretically unlimited; where staged wagering is employed as opposed to traditional table wagering; where an enhanced method for measuring player poker hands is employed; and where a method that enables a variety of payout schemes (other than just winner-takes-all) is utilized. First, players elect to enter the game, which, in some embodiments, is subject to an entry deadline. In some embodiments an entry fee or "ante" is required as a precondition to playing. Next, a sub-set of playing cards (the "community cards") are randomly selected from a plurality of playing cards (the "deck"). The number of community cards may vary, but will typically range from two to five. Community Cards are then removed from the deck and displayed face down with the remaining cards in the deck constituting a second plurality of cards (the "unallocated deck"). The community cards are not revealed to the players at this time. Next, each player is randomly assigned a sub-set of playing cards ("hole cards") from the unallocated deck. Any number of hole cards is assigned to each player, but this number is typically between two and five. The assignment of cards from the unallocated deck is not mutually exclusive. In other words, any number of players will each have the same card or set of cards as their hole cards. However, no single player will be allotted two of the same card. For example, a given player will not have two jacks of clubs in their hand, though it is anticipated that many jacks of clubs are allocated across several players. During play, the player's hole cards are revealed at various stages only to that player with no other player having visibility to that player's hole cards. Next, the community cards are exposed to all players and the first round of staged wagering is implemented whereby players are offered a limited time to elect and submit an additional wager of real or virtual currency to stay in the game. Otherwise, the player folds and exits the game. Once all players have made a declaration (or have folded by default due to the expiration of time), a portion of each player's hole cards are revealed and a subsequent round of staged wagering is implemented. This process continues for successive rounds until all of the player's hole cards have been revealed. After all hole cards have been revealed and a final round of staged wagering has concluded, the remaining players' hands are objectively measured, for example, using a scoring methodology that provides for greater granularity and differentiation than the traditional rules of poker as, for example, there will be multiple jacks of clubs, etc. Next each player's hand is ranked with the highest-ranking player(s) awarded a payout or a prize based on a pre-set schedule or formula that may include various formulations in addition the winner-takes-all formula employed in traditional poker. In some embodiments, payout is made by place (i.e. $1^{st}$ wins X, $2^{nd}$ wins Y . . . ), tier ($1^{st}$ through $10^{th}$ wins X, $11^{th}$ through 201th wins Y . . . ), or percentile (top 10% win X, >10% to 20% win Y . . . ).

In another embodiment, a gaming system is disclosed where the number of entrants is theoretically unlimited. This embodiment includes a server; where staged wagering is employed as opposed to traditional table wagering; where an enhanced method for measuring player poker hands is employed; and where a method that enables a variety of payout schemes (other than just winner-takes-all) is utilized. There are several player devices connected to the server. Through their devices, players access a user-interface and enter a game or contest. In some embodiments, players are required to pay an entry fee or "ante" as a precondition of play. The player devices then transmit player entries to the server where they are recorded. Once the entry deadline expires and all entries have been transmitted and recorded, the server initiates the game. First, the server randomly selects a sub-set of playing cards (the "community cards") from a plurality of playing cards (the "deck"). The number of community cards is any number, typically ranging from two to five cards. The community cards are removed from the deck and displayed face down in the user-interface, with the remaining cards in the deck constituting a second plurality of cards (the "unallocated deck"). Next, the server randomly assigns each player a sub-set of playing cards ("hole cards") from the unallocated deck. The number of hole cards assigned to each player can vary, but will typically be between two and five. The assignment of cards from the unallocated deck is not mutually exclusive and it is anticipated that multiple players will each have the same card or set of cards as their hold cards. However, no single player will be allotted two of the same card. The server then reveals to all players the community cards (e.g. turns face up). At this time, a player's hole cards are revealed sequentially intermixed with rounds of betting. Each player's hole cards are revealed only to that player with no other player having the ability to see other player's hole cards. Next, the server initiates the first round of staged wagering whereby players, through the user-interface, have a limited time to submit an additional wager of real or virtual currency and stay in the game or fold and exit the game. Player devices, through the user-interface, accept player submissions and then transmit the submissions to the server where they are recorded. Once all players have entered a submission (or have folded by default by failing to enter a submission before the expiration of the time limit), the server reveals a portion of the hole cards to each of the remaining players and a subsequent round of staged wagering is implemented. This process continues for successive rounds until all of the hole cards have been revealed. After all hole cards have been revealed and a final round of staged wagering has concluded, the server analyzes and objectively scores the hands of the remaining players using, for example, an enhanced method for measuring player poker hands to provide greater granularity and differentiation than provided for by the traditional rules of poker as there are many duplicate cards having the same value. The server then ranks the hands of the players and utilizes a payout engine whereby players with the highest-ranking hands are awarded a payout or a prize based on a pre-set schedule or formula that, in some embodiments, includes various formulations in addition the winner-takes-all formula employed in traditional poker. In some embodiments, the payout includes, but is not limited to, payout by place (i.e. $1^{st}$ wins X, $2^{nd}$ wins Y . . . ), tier ($1^{st}$ through $10^{th}$ wins X, $11^{th}$ through 201th wins Y . . . ), or percentile (top 10% win X, >10% to 20% win Y . . . ). In this, the betting, and hence, outcome of the game is influenced by the skill and knowledge of the users.

In one embodiment, a game format for poker is disclosed where the number of players is theoretically unlimited; where staged wagering is employed as opposed to traditional table wagering; where an enhanced method for measuring player poker hands is employed; and where a method that enables a variety of payout schemes (other than just winner-takes-all) is utilized. First, players elect to enter the game, which is anticipated to be subject to an entry deadline. In some embodiments, the players are required to pay an entry fee or "ante" as a precondition. Next, a sub-set of playing cards (the "community cards") are randomly selected from a plurality of playing cards (the "deck"). Any number of community cards is anticipated, typically ranging from two to five cards. Community cards are then removed from the deck and displayed face down with the remaining cards in the deck constituting a second plurality of cards (the "unallocated deck"). The community cards are not revealed to the players at this time. Next, the each player is randomly assigned a sub-set of playing cards ("hole cards") from the unallocated deck. The number of hole cards assigned to each player can vary, but will typically be between two and five. The assignment of cards from the unallocated deck is not mutually exclusive as multiple players will each have the same card or set of cards for their hole cards. However, no single player will be allotted two of the same card. For example, a player will not have two Jacks of Clubs in their hand.

Each player's hole cards are revealed sequentially intermixed with rounds of betting. Each player's hole cards are visible only to that player with no other player having the ability to see other player's hole cards. Staged wagering is implemented whereby players are offered a limited time to fold and exit the game or stay in the game by submitting an additional wager, if required. If a player does not affirmatively elect to fold or submit the additional requisite wager in time, then by default, when the time deadline has elapsed, in some embodiments, the requisite wager is automatically submitted and they stay in the game while in other embodiments, the player is automatically folded. Once all players have made a declaration (or have folded), a portion of the hole cards are revealed and a subsequent round of staged wagering is implemented. This process continues for successive rounds until all of the hole cards have been revealed. After all hole cards have been revealed and a final round of staged wagering has concluded, the remaining players' hands are objectively measured using, for example, a scoring methodology that provides for greater granularity and differentiation than the traditional rules of poker (as the hands will include multiples of each card of the unallocated deck). Next each player's hand is ranked with the highest-ranking player's hand awarded a payout or a prize based on a pre-set schedule or formula that, in some embodiments, includes various formulations in addition the winner-takes-all formula as employed in traditional poker. In some embodiments, payout is made by place (i.e. $1^{st}$ wins X, $2^{nd}$ wins Y . . . ), tier ($1^{st}$ through $10^{th}$ wins X, $11^{th}$ through 201th wins Y . . . ), or percentile (top 10% win X, >10% to 20% win Y . . . ).

In another embodiment, a gaming system is disclosed where the number of entrants is theoretically unlimited that includes a server; where staged wagering is employed as opposed to traditional table wagering; where an enhanced method for measuring player poker hands is employed; and where a method that enables a variety of payout schemes (other than just winner-takes-all) is utilized. There are several player devices connected to the server. Through their devices, players access a user-interface and enter a game or contest. Entry may or may not require an entry fee or "ante" as a precondition. The player devices then transmit player entries to the server where they are recorded. Once the entry deadline expires and all entries have been transmitted and recorded, the server initiates the game. First, the server randomly selects a sub-set of playing cards (the "community cards") from a plurality of playing cards (the "deck"). The number of community cards may vary, but will typically range from two to five. The community cards are removed from the deck and displayed face down in the user-interface, with the remaining cards in the Deck constituting a second plurality of cards (the "unallocated deck"). Next, the server randomly assigns each player a sub-set of playing cards ("hole cards") from the unallocated deck. The number of hole cards assigned to each player can vary, but will typically be between two and five. The assignment of cards from the unallocated deck is not mutually exclusive and multiple players are anticipated to have the same card or set of cards as their hole cards. However, no single player will be allotted two of the same card. The server then reveals to all players the community cards face up. A subset of each of the player's hole cards are revealed only to that player with no other player having the ability to see other player's hole cards. Next, the server initiates the first round of staged wagering whereby players, through the user-interface, have a limited amount of time to fold and exit the game, or stay in the game by submitting an additional wager, if required. In some embodiments, if a player does not affirmatively elect to fold before the time deadline or submit the additional requisite wager and stay in the game, then by default, when the time deadline has elapsed, the requisite wager is automatically submitted and they stay in the game. Player devices, through the user-interface, accept player submissions (affirmative or by default) and then transmit the submissions to the server where they are recorded. Once all players have entered a submission (or have folded by default by failing to enter a submission before the expiration of the time limit), the server reveals a portion of each of the remaining player's hole cards to those players only and a subsequent round of staged wagering is implemented. This process continues for successive rounds until all of the hole cards have been revealed. After all hole cards have been revealed and a final round of staged wagering has concluded, the server analyzes and objectively scores the hands of the remaining players, for example, using an enhanced method for measuring player poker hands to provide greater granularity and differentiation than provided for by the traditional rules of poker. The server then ranks the hands of the players and utilizes a payout engine whereby players with the highest-ranking hand(s) are awarded a payout or a prize based on a pre-set schedule or formula that may include various formulations such as the winner-takes-all formula employed in traditional poker or other payout formulae such as payout by place (i.e. $1^{st}$ wins X, $2^{nd}$ wins Y . . . ), tier ($1^{st}$ through $10^{th}$ wins X, $11^{th}$ through 201th wins Y . . . ), or percentile (top 10% win X, >10% to 20% win Y . . . ). In this, the outcome of the game is influenced by the betting skills and knowledge of the players.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
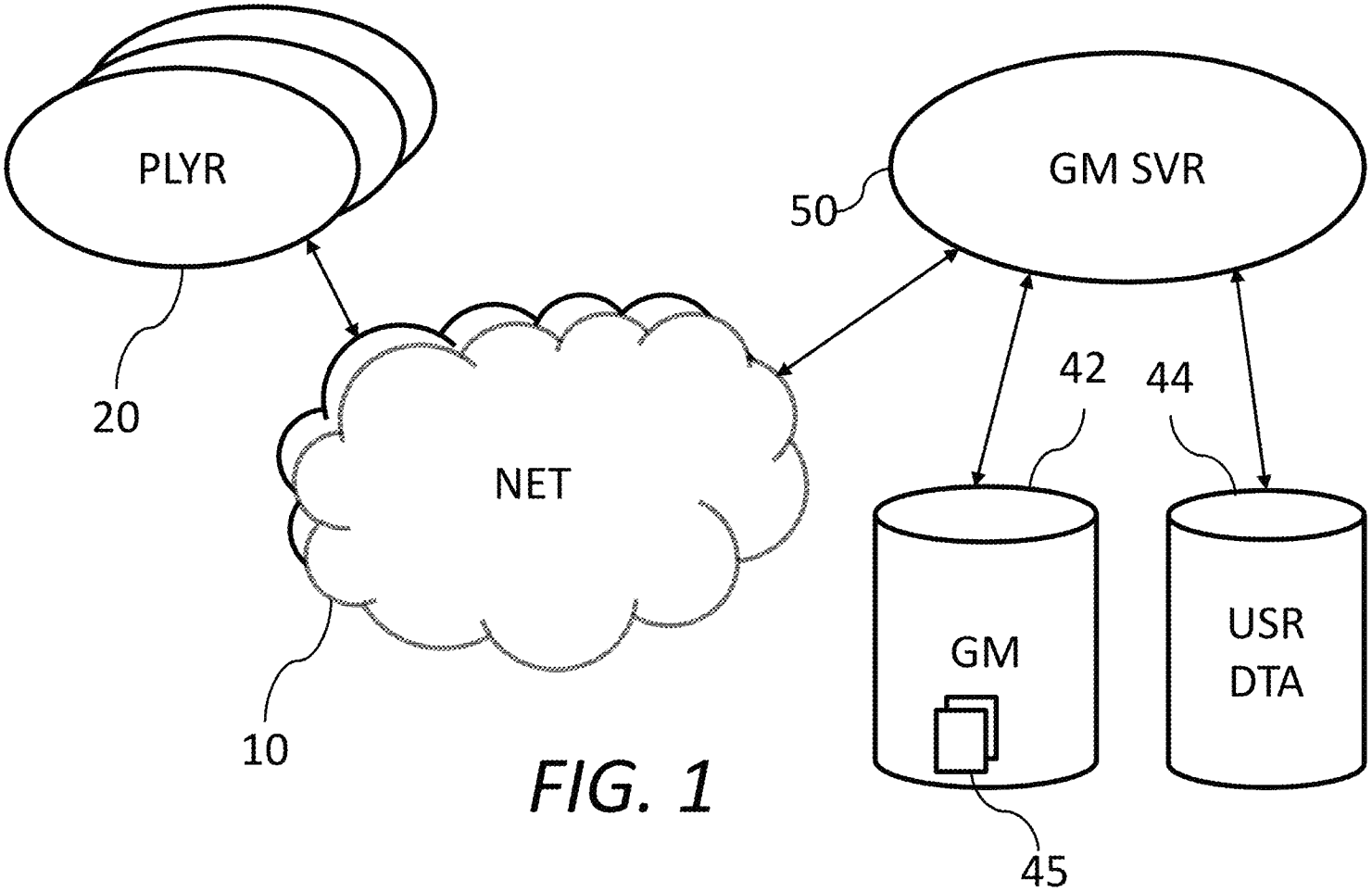
FIG. 1 illustrates schematic view of a skill gaming system.

Reference will now be made in detail to the presently preferred embodiments of the invention, examples of which are illustrated in the accompanying drawings. Throughout the following detailed description, the same reference numerals refer to the same elements in all figures.

Throughout this description, an example is made using a gaming system that is similar to the well-known game of poker. It is fully anticipated to implement the same or similar gaming system using solitaire, trivia, board games, etc., having multiple rounds of betting in which each player makes bets based upon how that player did during the current round, before executing the next round.

Referring to FIG. 1, a schematic view of a gaming system is shown. Multiple player client devices 20 (computers, smart phones, etc.) connect to the game server 40 through a network 10, for example, through the Internet.

Game details and settings are stored in a game storage area 42 that is accessible by the game server 40, such as, the deck, community cards, each player's hands, number of players, total amount in the pot, etc. User data storage that is accessible by the game server 40 includes data such as login credentials, preferences, available funds, name, picture, etc., are stored in a user data area 44.

Figure 2:
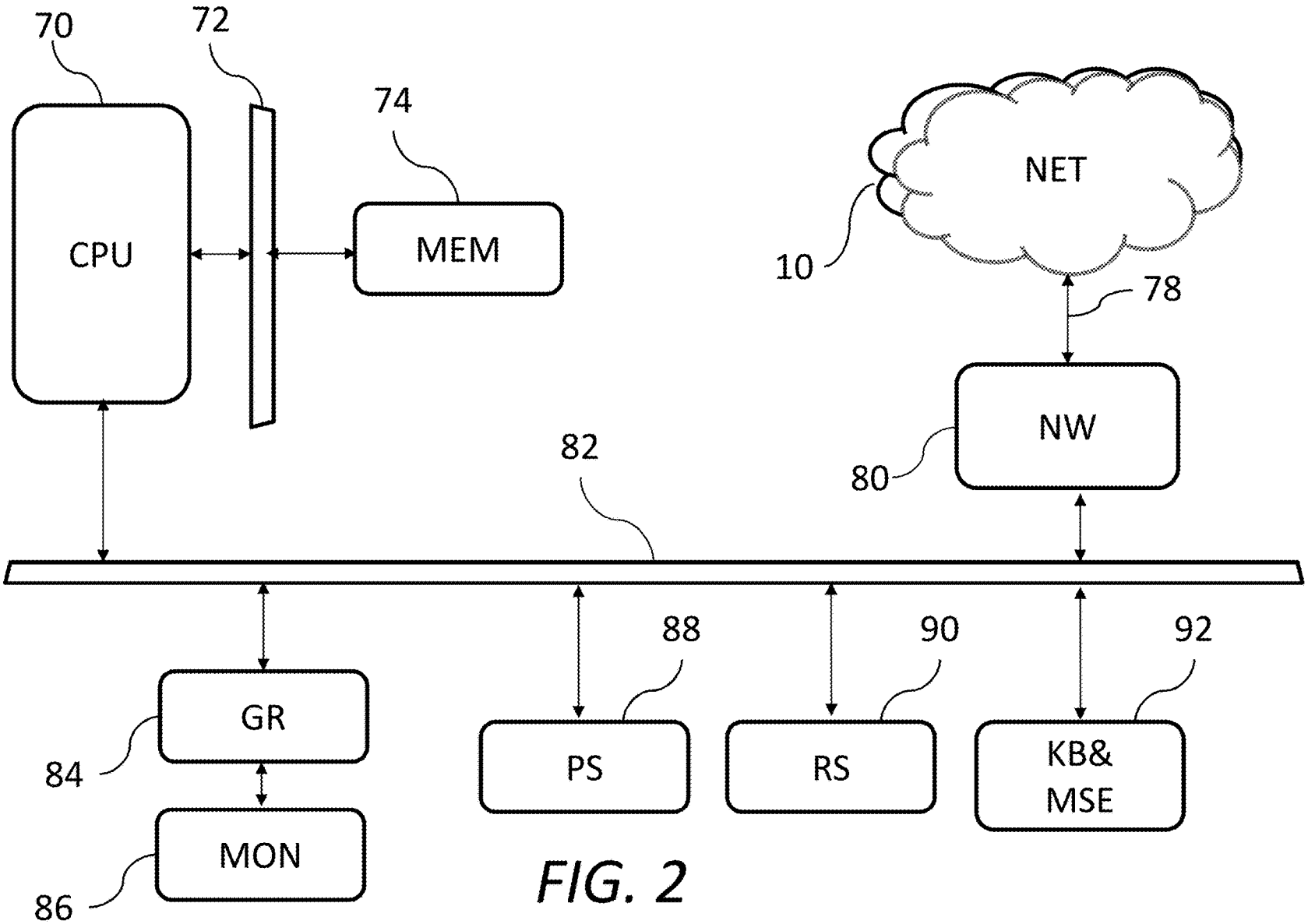
FIG. 2 illustrates a typical computer system.

Referring to FIG. 2, a schematic view of a typical computer system is shown. The example computer system represents a typical computer system used as the game server 40 and/or the player client devices 20. The example computer system is shown in its simplest form, having a single processor. Many different computer architectures are known that accomplish similar results in a similar fashion and the present invention is not limited in any way to any particular computer system. The present invention works well utilizing a single processor system, as shown in FIG. 2, a multiple processor system where multiple processors share resources such as memory and storage, a multiple server system where several independent servers operate in parallel (perhaps having shared access to the data), or any combination, etc. In such systems, a processor 70 executes or runs stored programs that are generally stored for execution within a memory 74. The processor 70 is any processor or a group of processors, for example an Intel Pentium-4 CPU or the like. The memory 74 is connected to the processor, for example, by a memory bus 72 and is any memory 74 suitable for connection with the selected processor 70, such as SRAM, DRAM, SDRAM, RDRAM, DDR, DDR-2, etc. Also interfaced to the processor 70 is a system bus 82, for example, interfacing peripheral subsystems such as a network interface 80, persistent storage 88 (e.g. a hard disk), removable storage (e.g. DVD, CD, flash drive) 90, a graphics adapter 84 and a keyboard/mouse 92, etc., to the processor 70. The graphics adapter 84 receives commands and display information from the system bus 82 and generates a display image that is displayed on the display 86.

In general, the persistent storage 88 is used to store programs, executable code and data such as user financial data in a persistent manner. The removable storage 90 is used to load/store programs, executable code, images and data onto the persistent storage 88.

These peripherals are examples of persistent storage 88 and other examples of persistent storage devices 88 include core memory, FRAM, flash memory, etc. Other examples of removable media storage 90 include CDRW, DVD, DVD writeable, Blu-ray, SD cards, other removable flash media, floppy disk, etc. In some embodiments, other devices are connected to the system through the system bus 82 or with other input-output connections/arrangements as known in the industry. Examples of these devices include printers; graphics tablets; joysticks; and communications adapters such as modems and Ethernet adapters.

The network interface 80 connects the computer-based system to the network 10 through a link 78 which is, preferably, a high speed link such as a cable broadband connection, a Digital Subscriber Loop (DSL) broadband connection, fiber optics, a T1 line, or a T3 line.

The server 50 maintains a representation of a deck of cards 45 (e.g. a set of cards from a standard poker deck, represented electronically) and during a game, software running on the server 50 randomly selects the community cards 132 from the deck of cards 45, eliminating the community cards 132 from the deck of cards 45. Then, the software running on the server 50 randomly selects each player's hole cards 130 from the remaining cards in the deck of cards 45. As the game progresses, the server 50 presents user interfaces a described later showing the community cards 132, collects bets from the player client devices 20, maintains the pot, etc. As each round of the game is made, the software running on the server 50 delivers one or more of the player's hole cards 130 to the player client devices 20 for display to the player for making decisions as to whether to remain in the game (pay more) or fold, etc.

Figure 3:
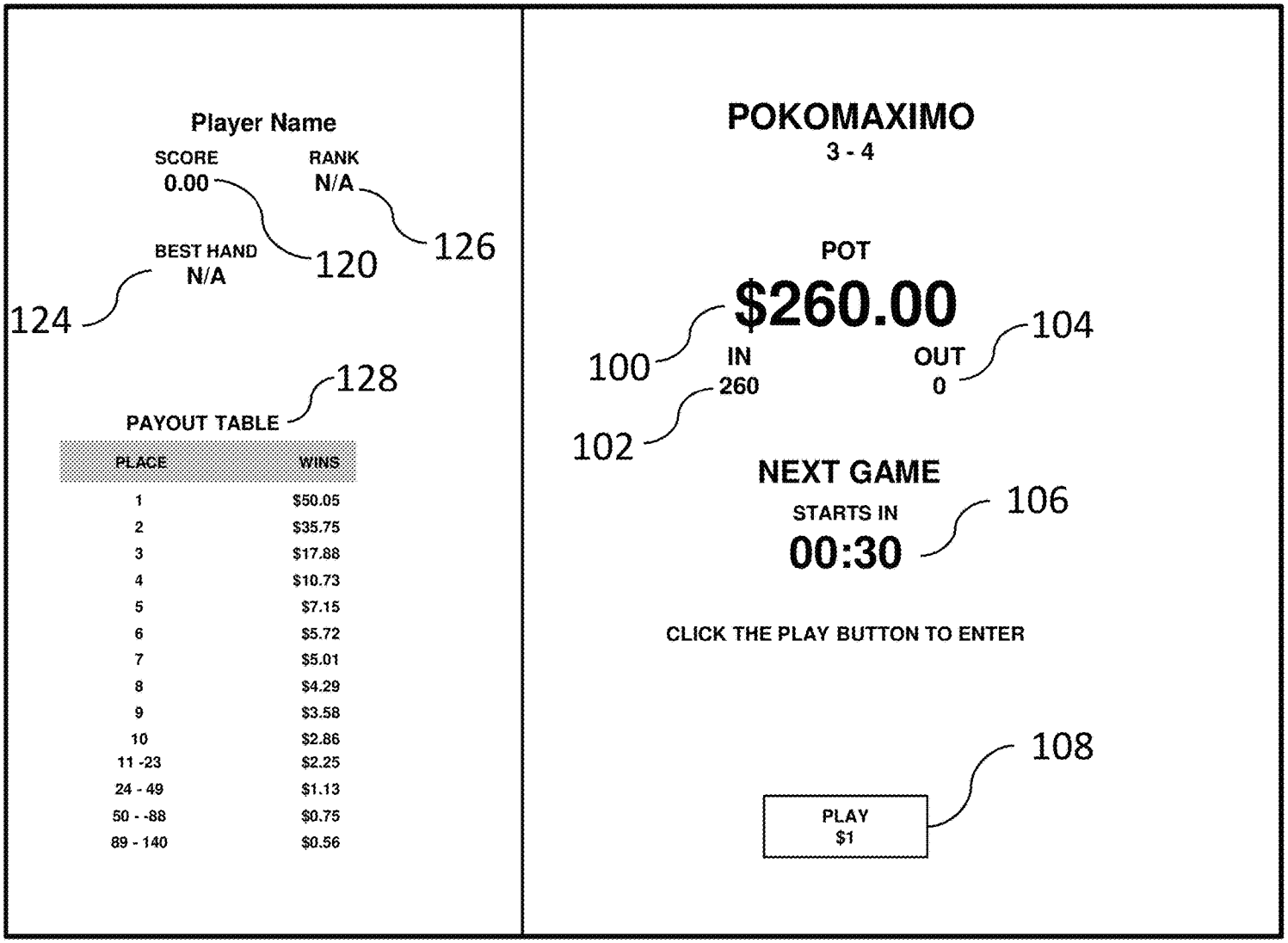
FIG. 3 a typical initial user-interface for the game format described in claim 2 where a player will be randomly dealt three Hole Cards with four cards designated as Community Cards.

FIG. 3 represents a typical initial user-interface for the game format where each player will be randomly dealt three hole cards with four cards designated as community cards. In this initial user-interface, an amount of real or virtual money in the pot 100 is shown, which grows as more players enter the contest. Since the game has yet to start, only the cumulative number of players that are in the game 102 is shown (e.g. 260 players) and the count of players who have folded and left the game 104 is shown as zero (nobody has folded yet). A countdown clock 106 indicates a deadline when new players will no longer be admitted and the game will start. A prospective player must depress an entry button 108 in order to play the game. In this example, the entry button 108 includes the amount required to play (the "ante"), if any shown as, for example, $1. In this embodiment, no cards are shown at this time, though in some embodiments, it is anticipated that one or more cards be exposed.

The player's current score 120 is displayed, which is zero since the game has yet to start. The player's current rank 126 is displayed, which shows as "N/A", again because the game has yet to start. The player's best hand 124 is displayed, which will be the best five card combination of their hole cards when combined with the visible community cards, again, no hand since the game has not commenced. Also, a projected payout table 128 is shown that displays the projected payouts based on the size of the pot 100, the number of players who played the game and the number of players that are currently in the game 102. As such, the projected payout table 128 is shown representing a pot of $260, as 260 players were in the game at the beginning of the game.

Figure 4:
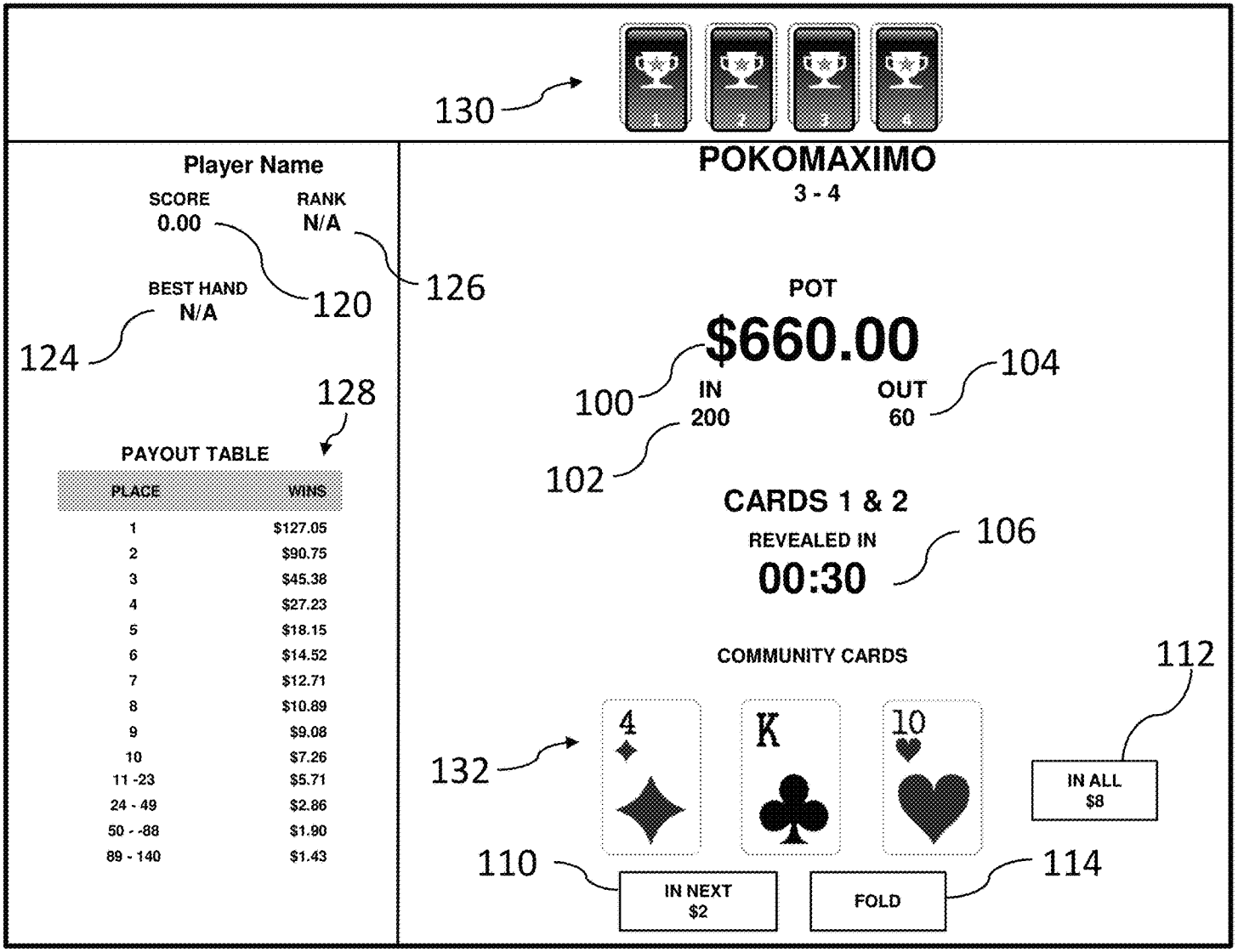
FIG. 4 illustrates the same user interface in FIG. 3 after the game has started.

FIG. 4 represents the same typical user interface after the game has started. The community cards 132 are now exposed to all players and betting is open (either the player bets or folds based upon the player's opinion of the community cards 132). The pot 100 has grown to $460 to reflect the 200 players who have elected to pay an additional $2 by selecting the "In Next" box 110, and remain in the game (the number of players that are currently in the game 102 indicates 200 players). The count of players who have folded and left the game 104 is now shown as 60 players, which represents the number of players who have elected to fold and exit the game (e.g. by default or by pressing the fold button 114). If a player does not want to bother with making each individual bet, the player selects the "IN ALL" button 112, which allows the player to pay (e.g. in this example, an additional $8) and stay in all subsequent rounds until the end of the game.

There are no changes yet to the player's current score 120, the player's current rank 126 and the player's best hand 124 as the player does not yet see any of their hole cards 130. Now, the projected payout table 128 reflects a payout schedule based on a pot 100 of $660, 260 players at the start of the game and currently 200 players still in the game (e.g. 260*$1+200*$2=$660). All of the hole cards 130 are shown face down. The three community cards 132 are shown face up to all players.

Figure 5:
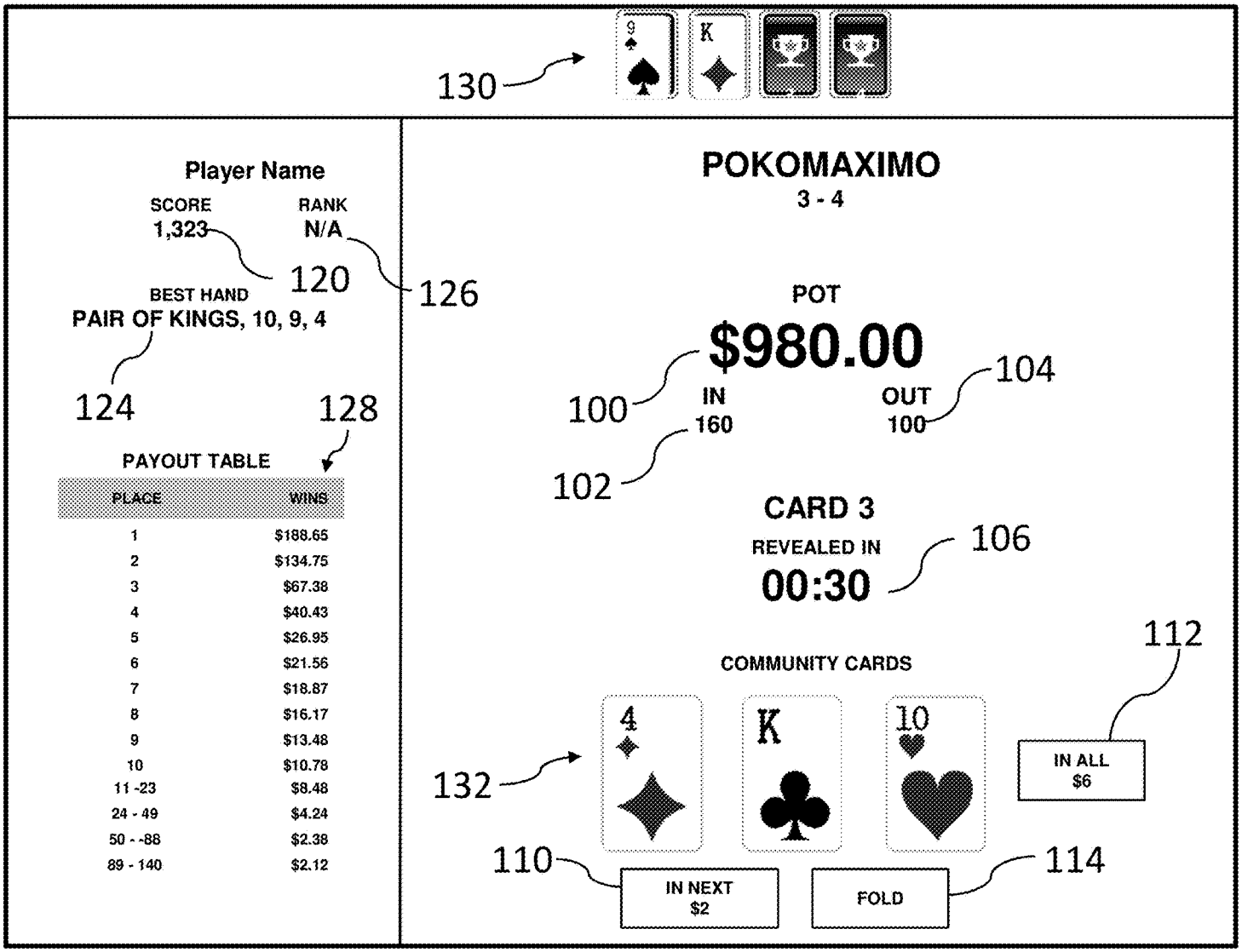
FIG. 5 illustrates the user interface in FIG. 3 after the initial round of staged wagering has been concluded, the player's Hold Cards have been dealt and revealed, and the first set of Community Cards are revealed.

FIG. 5 represents the same typical user interface after the initial round of staged wagering has been concluded. In this, two of the player's hole cards 130 have been revealed (only to that player). The projected payout table 128 reflects a payout schedule based on a pot 100 that is now $980 to reflect the additional fees for the number of players that are currently in the game 102 which is now 160 player (the count of players who have folded and left the game 104 is now 100) to reflect an additional 40 players who have folded. The countdown clock 106 indicates the time (e.g. 30 seconds) until the third card from the hole cards 130 will be revealed. This is the deadline for all players to submit the required additional payment by selecting the "In Next" box 110 to remain in the game or to fold by selecting the fold button 114. If no action is taken, when the countdown clock 106 reaches zero, the default action will be taken (e.g. the player will automatically fold). Note that the "In Next" box 110 and the "IN ALL" box 112 display fees that correspond with the stage of the game (e.g., $2 and $6, respectively).

The player's current score 120 is now 1,323 based upon five cards (the three community cards 132 and the two hole cards 130). The player's current rank 126 remains as "N/A" and the player's best hand 124 at this time now shows the player's best hand combination from the five visible cards (e.g., a pair of kings, A, 10, 9 high). The projected payout table 128 reflects a payout schedule based on a pot 100 that is now $980. The hole cards 130 shows the faces of the first two hole cards 130 with the other two hole cards 130 remaining face down.

Figure 6:
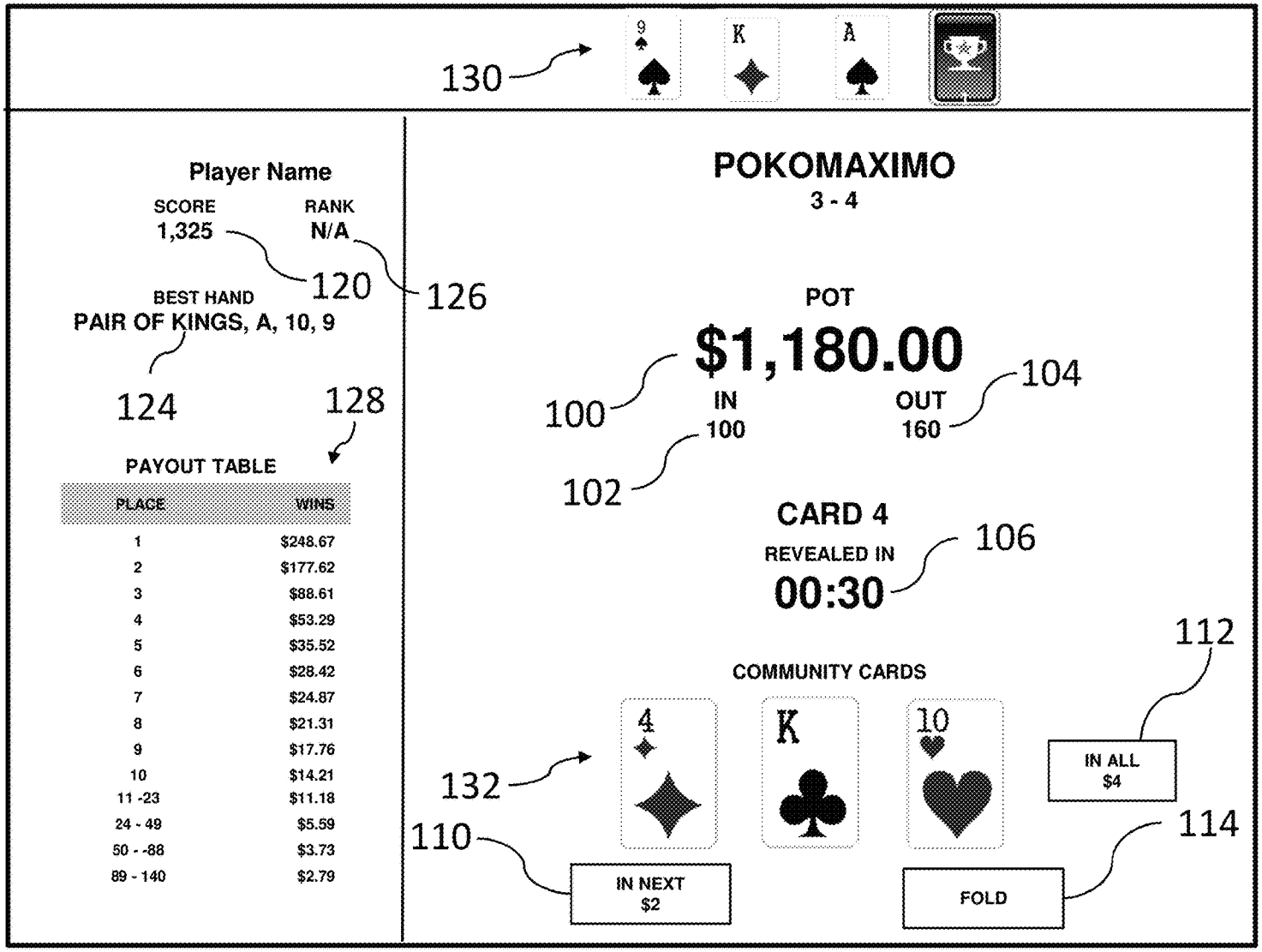
FIG. 6 illustrates the user interface in FIG. 3 after the second round of staged wagering has been concluded and the third of four Community Cards is revealed.

FIG. 6 represents the same typical user interface after the second round of staged wagering has been concluded. In this, the hole cards 130 now shows the third hole cards 130 that is now revealed only to this player. The projected payout table 128 reflects a payout schedule based on a pot 100 that is now $1,180 to reflect the additional fees for the number of players that are currently in the game 102 which is now 100 players (the count of players who have folded and left the game 104 is now 160) as an additional 40 players who have folded. The countdown clock 106 indicates the time (e.g. 30 seconds) until the fourth card from the hole cards 130 will be revealed. This is the deadline for all players to submit the required additional payment by selecting the "In Next" box 110 to remain in the game or to fold by selecting the fold button 114. If no action is taken, when the countdown clock 106 reaches zero, the default action will be taken (e.g. the player will automatically fold). Note that the "In Next" box 110 and the "IN ALL" box 112 display fees that correspond with the stage of the game (e.g., $2 and $4, respectively).

The player's current score 120 is now 1,325 based upon six cards (the three hold cards and the three community cards). The player's current rank 126 remains as "N/A" and the player's best hand 124 at this time now shows the player's best hand combination from the five visible cards (e.g., a pair of kings, A, 10, 9 high). The projected payout table 128 reflects a payout schedule based on a pot 100 that is now $1,180. The hole cards 130 shows the faces of the first three hole cards 130 with the final hole card 130 remaining face down.

Figure 7:
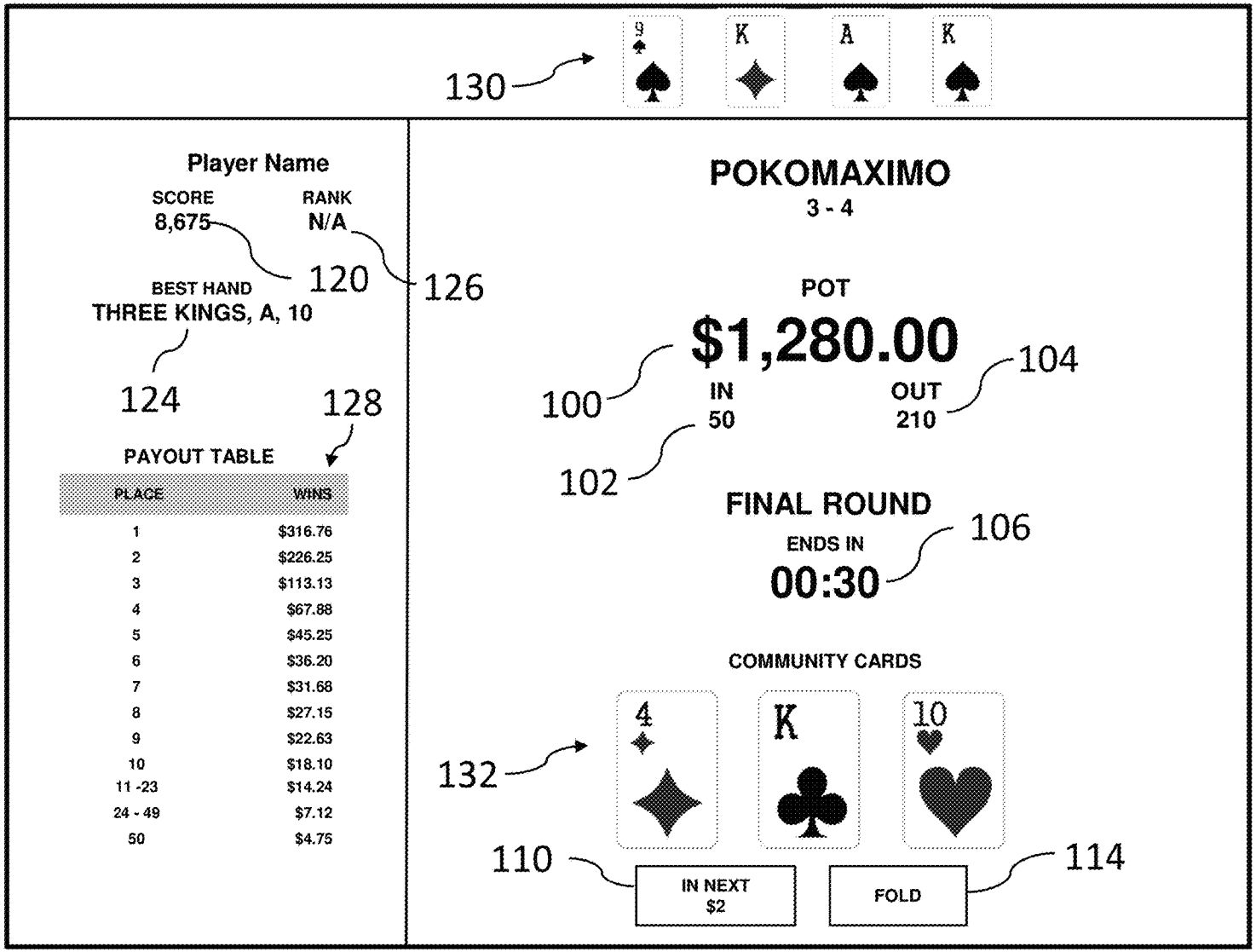
FIG. 7 illustrates the user interface in FIG. 3 after the third round of staged wagering has been concluded and the fourth of four Community Cards is revealed.

FIG. 7 represents the same typical user interface after the third round of staged wagering has been concluded. In this, the hole cards 130 now shows the fourth and last hole card 130 that is now revealed only to this player. The projected payout table 128 reflects a payout schedule based on a pot 100 that is now $1,280 to reflect the additional fees for the number of players that are currently in the game 102 which is now 50 players (the count of players who have folded and left the game 104 is now 210) as additional players have folded. The countdown clock 106 indicates the time (e.g. 30 seconds) until the game ends. This is the deadline for all players to submit the required additional payment by selecting the "In Next" box 110 to remain in the game or to fold by selecting the fold button 114. If no action is taken, when the countdown clock 106 reaches zero, the default action will be taken (e.g. the player will automatically fold). Note that the "In Next" box 110 displays fees that correspond with the final stage of the game (e.g., $2).

The player's current score 120 is now 8675 based upon seven cards (the three community cards 132 and the four hole cards 130). The player's current rank 126 remains as "N/A" and the player's best hand 124 at this time now shows the player's best hand combination from the seven cards (e.g., three kings, A, 10 high). The projected payout table 128 reflects a payout schedule based on a pot 100 that is now $1,280. The faces of the all four hole cards 130 are shown.

Figure 8:
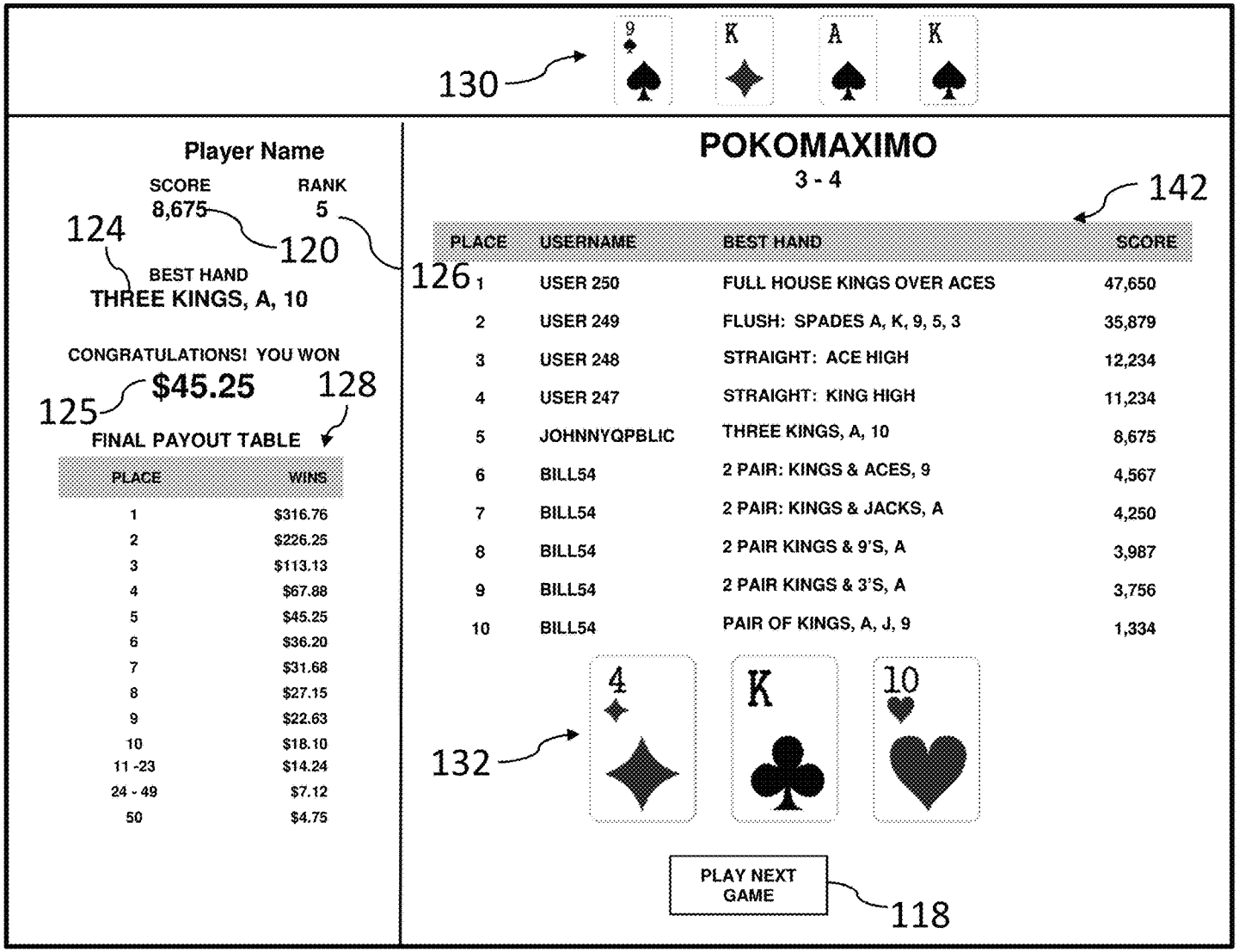
FIG. 8 illustrates the user interface in FIG. 3 after the fourth and final round of staged wagering and a final ranking and payout has occurred.

FIG. 8 represents the same typical user interface after the fourth and final round of staged wagering. The projected payout table 128 reflects a payout schedule based on a pot 100 that is $1,280 (see FIG. 7). The "In Next" button 110 and the fold button 114 are no longer displayed since they are no longer applicable. A next game button 118 enables the player to play in the next game, which in preferred embodiments occurs sequentially after the current game ends.

The player's current score 120 is 8675 based upon seven cards (the three community cards 132 and the four hole cards 130). The player's current rank 126 now shows their rank as fifth (e.g. three kings tanks as fifth out of all of the remaining players) and the player's best hand 124 at this time now shows the player's best hand combination from the five visible cards (e.g., three kings, A, 10 high). The projected payout table 128 reflects a payout schedule based on a pot 100 of $1,280. The faces of all hole cards 130 are shown to the player. The amount won 125 by the player 142 is shown based on player's current score 120 (e.g. 8,675) and the player's current rank 126 (e.g. fifth) dividing a portion of the pot 100 (e.g. the pot 100 minus a fixed amount or percentage retained by the house) between some number of the highest ranking players (in this example, 50).

It is fully anticipated to provide different variations of the gaming system with more or less rounds of betting. For example, in some embodiments, betting is performed only after the player sees one or more of the player's hole cards 130. In some embodiments, the bet changes for each round, increasing or decreasing. In some embodiments, there are more or less hole cards 130 and the hole cards are exposed in the same or different sequences such as one hole card 130 at a time; two hole cards 130, one and one; three hole cards 130, one and one, etc. In some embodiments, there are more or less community cards 132, for example, two community cards 132 or four community cards 132.

In general, ranking of hands in poker is well known (e.g. a royal flush, a straight flush, four of a kind, a full-house . . . ) and is generally ranked between the best five cards (e.g. a pair of aces, king, ten, three high). As the disclosed system is intended for a large number of concurrent players, it is anticipated that more granularity will be needed to break ties, as, for example, it is possible that several players have the same best five cards (e.g. four kings, ace high). In such, it is anticipated to utilize all cards (e.g. four hole cards and three community cards) and, therefore, the hand four kings, ace, seven, four will beat the hand four kings, ace, seven two. In some embodiments, it is anticipated that suits will be given differentiating value (e.g. spades highest, then hearts, diamonds, and clubs). With such, if two hands have the same run (A, K, Q, J, 10), then the hand with the ace of spades will beat the hand with the ace of hearts. In some embodiments, a combination of both the suit and more than five cards is considered in ranking the hands.

Although the above examples describe an initial showing of the community cards followed by sequential betting and showing of a player's hole cards, it is equally anticipated that there be an initial showing of the player's hole cards (the player is only able to see their own hole cards) along with sequential betting and showing of the community cards.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A gaming system comprising:

a server;

a plurality of player client devices, each associated with a player;

a software representation of a deck of cards;

the server randomly selects and removes a set of community cards from the deck of the cards, a remaining set of cards remain in the deck of the cards;

the server requests a wager concurrently from each player client device and starts a time period;

after the time period ends, for the each player client device that made the wager within the time period: the each player client device that made the wager within the time period is declared as playing, the server collects the wager and adds the wager to a pot, the server randomly selects a non-exclusive set of hole cards from the remaining set of cards, the server reveals the set of community cards on the each player client device, the server reveals a first subset of the hole cards on the each player client device, and the server concurrently requests a next wager from the each player client device that was declared as playing to open a second round of betting; and the server starts a next time period;

until all betting rounds have concluded: after the next time period ends, the each player client device that made the next wager within the next time period is declared as playing, for each of the player client devices that is playing: the server collects the next wager and adds the next wager to the pot, the server reveals a next subset of the hole cards on the each player client device, and the server concurrently requests the next wager from the each player client device be made within the next time period; and the server starts the next time period; and after all betting rounds have concluded, a plurality of winners is declared based upon a rank of hands, the hands comprising the hole cards of each player and the set of community cards.

2. The gaming system of claim 1, wherein the deck of the cards is a digital representation of a standard poker deck of 52 cards.

3. The gaming system of claim 1, wherein the plurality of winners includes a top percentage of the hands based on a payout table.

4. The gaming system of claim 1, wherein the plurality of winners includes a top number of the hands based on a payout table.

5. The gaming system of claim 1, wherein the plurality of winners includes a top number of the hands based upon tiers using a payout table.

6. The gaming system of claim 1, wherein a portion of the pot is retained as a fee.

7. The gaming system of claim 1, wherein the set of community cards is three cards.

8. The gaming system of claim 1, wherein the time period is not equal to the next time period.

9. A method of gaming by a set of players, the method comprising:

randomly selecting and removing a set of community cards from a digital representation of a deck of cards, leaving a remaining set of cards in the digital representation of the deck of the cards;

on a display associated with each player, requesting a first wager within a time period;

after the time period expires, for the each player that made the first wager within the time period: adding the first wager to a pot and adding the each player to a set of active players;

for the each player in the set of active players, randomly selecting a non-exclusive set of hole cards from the remaining set of the cards in the digital representation of the deck of the cards;

revealing the set of community cards and a subset of the hole cards for the each player in the set of active players concurrently on the display associated with the each player that is in the set of active players;

concurrently requesting a next wager from each player that is in the set of active players and starting a next time period;

until all hole cards are revealed, after the next time period expires, removing each player that failed to make the next wager from the set of active players, then for the each player that remains in the set of active players: adding the next wager to the pot, revealing and displaying a next subset of the hole cards for the each player on the display associated with the each player that is in the set of active players and concurrently displaying a request that the next wager be made within the next time by the each player on the display associated with the each player in the set of active players; and after all hole cards are revealed to the each player that is in the set of active players, ranking a hand of each player in the set of active players and declaring a plurality of winners based upon a ranking, the hand of each player comprising the hole cards of the each player and the set of community cards.

10. The method of claim 9, wherein the digital representation of the deck of the cards is a computer representation of a standard poker deck of 52 cards.

11. The method of claim 9, wherein the plurality of winners includes a top percentage of the hands based on a payout table.

12. The method of claim 9, wherein the plurality of winners includes a top number of the hands based on a payout table.

13. The method of claim 9, wherein the non-exclusive set of the hole cards is an empty set.

14. The method of claim 9, wherein the non-exclusive set of the hole cards is four cards.

15. Program instructions tangibly embodied in a non-transitory storage medium comprising at least one instruction configured to implement a system for gaming between a set of players, wherein the at least one instruction comprises:

computer readable instructions executed by a processor causing the system for gaming to randomly select and remove a set of community cards from a deck of cards, leaving a remaining set of cards in the deck of the cards;

the computer readable instructions executed by the processor causing the system for gaming to request a first wager concurrently from each player of the set of players and to start a time period;

after the time period ends, the computer readable instructions executed by the processor causing the system for gaming to remove each player that fails to make the first wager within the time period from the set of players and for each player remaining in the set of players: the computer readable instructions executed by the processor causing the system for gaming to add the wager to a pot, the computer readable instructions executed by the processor causing the system for gaming to randomly select a non-exclusive set of hole cards from the deck of cards for the each player in the set of players, the computer readable instructions executed by the processor causing the system for gaming to reveal the set of community cards to all players in the set of players, and for the each player in the set of players, the computer readable instructions executed by the processor causing the system for gaming to reveal a first subset of the each player's non-exclusive set of hole cards, and the computer readable instructions executed by the processor causing the system for gaming to concurrently request a next wager from the each player that is in the set of players; and the computer readable instructions executed by the processor causing the system for gaming to start a next time period;

until all hole cards are revealed: after the next period of time expires, removing players that fail to make the next wager from the set of players and, for each player remaining in the set of players: the computer readable instructions executed by the processor causing the system for gaming to add the wager to the pot and for the each player in the set of players, the computer readable instructions executed by the processor causing the system for gaming to reveal a next subset of the each player's non-exclusive set of hole cards; and the computer readable instructions executed by the processor causing the system for gaming to reset the next time period; and after all hole cards are revealed, the computer readable instructions executed by the processor causing the system for gaming to rank a hand of each player in the set of players, and to declare a plurality of winners based upon the rank of the hand of each player in the set of players, each of the hands comprising the hole cards of the each player and the set of community cards.

16. The program instructions tangibly embodied in the non-transitory storage medium comprising the at least one instruction configured to implement a system for gaming between the set of players of claim 15, wherein the at least one instruction that comprises the computer readable instructions executed by the processor causing the system for gaming to randomly select and remove the set of community cards from the deck of the cards selects removes three of the cards from the deck of the cards, the deck of the cards represents a standard poker deck of 52 cards.

17. The program instructions tangibly embodied in the non-transitory storage medium comprising the at least one instruction configured to implement the system for gaming between the set of players of claim 15, wherein the at least one instruction that comprises computer readable instructions executed by a processor causing the system for gaming to declare the plurality of winners based upon a ranking the plurality of winners includes the computer readable instructions executed by the processor causing the system for gaming to declare the plurality of winners based upon a top percentage of hands and rewarding the players with the top percentage of hands based upon a payout table.

18. The program instructions tangibly embodied in the non-transitory storage medium comprising the at least one instruction configured to implement the system for gaming between the set of players of claim 15, wherein the at least one instruction that comprises the computer readable instructions executed by the processor causing the system for gaming to declare the plurality of winners based upon a ranking of the plurality of winners includes the computer readable instructions executed by the processor causing the system for gaming to declare the plurality of winners based upon a top number of hands and rewarding the players with the top number of hands based upon a payout table.

19. The program instructions tangibly embodied in the non-transitory storage medium comprising the at least one instruction configured to implement the system for gaming between the set of players of claim 15, wherein the computer readable instructions executed by the processor causing the system for gaming to randomly select and remove the set of community cards from the deck of the cards randomly selects and removes three cards.

20. The program instructions tangibly embodied in the non-transitory storage medium comprising the at least one instruction configured to implement the system for gaming between the set of players of claim 15, wherein the computer readable instructions executed by the processor causing the system for gaming to randomly select the non-exclusive set of hole cards from the deck of the cards randomly by selecting four non-exclusive hole cards.

* * * * *